US006945072B2

(12) United States Patent
Kim et al.

(10) Patent No.: US 6,945,072 B2
(45) Date of Patent: Sep. 20, 2005

(54) BUILT-IN TYPE OUTDOOR UNIT FOR AIR CONDITIONER

(75) Inventors: In-Gyu Kim, Jinhae-Shi (KR); Young-Yu Bae, Changwon-Shi (KR); Jac-Hyung Koo, Changwon-Shi (KR); Byung-Il Park, Changwon-Shi (KR); Kyeong-Ho Kim, Changwon-Shi (KR); Yang-Ho Kim, Changwon-Shi (KR); Young-Ho Hong, Changwon-shi (KR); Kyeong-Wook Heo, Kimhae-shi (KR); Kang-Wook Cha, Changwon-shi (KR); Si-Kyong Sung, Changwon-Shi (KR); Dong-Hyuk Lee, Jinhae-Shi (KR); Seong-Min Kang, Seoul (KR); Tae-Geun Kim, Changwon-Shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/470,900

(22) PCT Filed: Apr. 18, 2003

(86) PCT No.: PCT/KR03/00793

§ 371 (c)(1),
(2), (4) Date: Aug. 1, 2003

(87) PCT Pub. No.: WO03/068542

PCT Pub. Date: Aug. 21, 2003

(65) Prior Publication Data

US 2004/0163410 A1 Aug. 26, 2004

(30) Foreign Application Priority Data

Feb. 26, 2003 (KR) ..... 10-2003-0012097

(51) Int. Cl.[7] ..... F25B 39/04

(52) U.S. Cl. ..... 62/428; 62/508

(58) Field of Search ..... 62/295–297, 428–429, 62/507, 508

(56) References Cited

U.S. PATENT DOCUMENTS 2,293,065 A 8/1942 Kiczales ..... 98/110
2,934,324 A * 4/1960 Partington ..... 165/296

(Continued)

FOREIGN PATENT DOCUMENTS

JP 03-213928 9/1991
JP 06-101873 4/1994

(Continued)

OTHER PUBLICATIONS

The reference was cited in an Office Action dated Apr. 18, 2005 for a corresponding Chinese Patent Application, which is not available at this time.

*Primary Examiner*—William E. Tapolcai
(74) *Attorney, Agent, or Firm*—Fleshner & Kim, LLP

(57) ABSTRACT

The present invention discloses a built-in type outdoor unit for an air conditioner to provide an efficient installation structure for installing the outdoor unit increased in capacity due to high air conditioning capacity in a built-in type. The built-in type outdoor unit includes a louver frame being fixedly installed on a rectangular space inner wall formed on an outer wall of a building, being divided into a suction area and a discharge area, having a plurality of louver blades in each area, and sucking and discharging air through gaps between the louver blades, and an outdoor unit casing being fixedly installed on the inside bottom of the building to contact the louver frame, and having its one surface facing the suction area and the discharge area of the louver frame opened and the other surfaces closed. A compressor for compressing a refrigerant gas supplied from an indoor unit through pipe lines, an air-cooled condenser for condensing the refrigerant gas from the compressor, and a cooling fan for supplying external air to the air-cooled condenser through the suction area, and discharging heat exchanged air through the discharge area are installed in the outdoor unit casing.

7 Claims, 6 Drawing Sheets

U.S. PATENT DOCUMENTS

| | | | | | |
|---|---|---|---|---|---|
| 4,261,418 | A | * | 4/1981 | Helt et al. | 165/134.1 |
| 4,723,419 | A | * | 2/1988 | Kessler et al. | 62/507 |
| 4,870,832 | A | * | 10/1989 | Crawley | 62/89 |
| 4,976,115 | A | * | 12/1990 | Hogan | 62/428 |
| 5,117,656 | A | * | 6/1992 | Keck et al. | 62/506 |
| 5,672,101 | A | * | 9/1997 | Thomas | 454/136 |
| 6,705,105 | B2 | * | 3/2004 | Wendt et al. | 62/298 |

FOREIGN PATENT DOCUMENTS

| | | | |
|---|---|---|---|
| JP | 2002-310498 | | 10/2002 |
| KR | 54-18043 | | 2/1979 |
| KR | 10-2002-0015916 | A | 3/2002 |
| KR | 2002-0039485 | | 5/2002 |
| KR | 2002-0097379 | | 12/2002 |

* cited by examiner

BUILT-IN TYPE OUTDOOR UNIT FOR AIR CONDITIONER

TECHNICAL FIELD

The present invention relates to an outdoor unit for an air conditioner, and more particularly to, a built-in type outdoor unit for an air conditioner which can be installed indoors.

BACKGROUND ART

An air conditioner implying a cooler, a heater or both of them is classified into a window type and a split type. In the case of the cooler, a split type air conditioner includes an indoor unit installed indoors for cooling a room, and an outdoor unit connected to the indoor unit through refrigerant pipe lines and installed outdoors to contact air, for performing condensation heat exchange on a refrigerant gas in a condenser by using external air as a cooling medium, and supplying the condensed refrigerants to an evaporator of the indoor unit through the refrigerant pipe lines. The indoor unit is composed of the evaporator for performing cooling heat exchange for evaporating the refrigerants and absorbing evaporation heat from internal air, and a ventilating fan for circulating internal air, and the outdoor unit is composed of a compressor for compressing the refrigerant gas and supplying the compressed gas to the condenser, the air-cooled condenser for condensing the refrigerant gas from the compressor, and a cooling fan for forcibly ventilating external air to the air-cooled condenser to cool and condense the refrigerant gas. The compressor, the air-cooled condenser and the cooling fan of the outdoor unit are installed in an outdoor unit casing composing the outer appearance. The conventional hexahedral outdoor unit casing has an air suction unit for sucking air to the air-cooled condenser at its three sides, and an air discharge unit for externally discharging air absorbing condensation heat from the refrigerant gas by the heat exchange in the air-cooled condenser on its top surface.

However, the conventional outdoor unit for the air conditioner is restricted in installation spaces due to high density and strict environment regulations of cities, and increases civil applications due to noise and heat. Especially, a common residential area such as large-scaled apartment buildings regulates the outdoor units to be installed in indoor verandas to improve the appearance and prevent noise.

In order to solve the foregoing problems, Japanese Laid-Open Patent Publication No. 6-101873 suggests an air conditioner mounted building where an indoor unit of an air conditioner is installed indoors or adjacent to a room intended to be air-conditioned, and an outdoor unit of the air conditioner is installed outdoors, wherein an opening is formed on the outer wall or roof, a louver is installed in the opening, the outdoor unit of the air conditioner is positioned in the louver, and suction/discharge of the indoor unit is performed through a gap between the louver plates.

In addition, Japanese Laid-Open Patent Publication No. 3-213928 discloses a wall built-in type outdoor unit for an air conditioner including an outdoor unit main body for the air conditioner which is built in the wall and which includes a frame having the same size and thickness as the wall, a suction hole for heat exchange air installed on the same surface as the outdoor unit main body, and a discharge hole for heat exchanged air.

However, the conventional arts relate merely to technologies for inserting the outdoor unit into a space formed on an outer wall of a building. That is, it is impossible to install the outdoor unit increased in volume and weight due to high air conditioning capacity in a built-in type.

The conventional outdoor unit is incorporated in one casing. In order to manage, examine or repair inside components of the outdoor unit, the whole outer casing must be separated/disassembled. In the case that the outdoor unit is a built-in type, a lot of money and time are required to disassemble the outer casing.

Moreover, the conventional outdoor unit has a large size and weight, and thus is difficult to install, transport and move.

DISCLOSURE OF THE INVENTION

An object of the present invention is to provide a realistic installation structure of a built-in type outdoor unit for an air conditioner which can built the outdoor unit in an outer wall of a commercial and/or residential building.

Another object of the present invention is to provide an efficient installation structure which can install an outdoor unit increased in capacity due to high air conditioning capacity in a built-in type.

Yet another object of the present invention is to provide a structure for easily fixing and separating an outdoor unit to/from an outer wall of a building, and a built-in type outdoor unit for an air conditioner having leg members for supporting, easily moving and transporting it.

Yet another object of the present invention is to provide an economical installation structure for efficiently installing a large capacity outdoor unit, and services for easily transporting the outdoor unit, and examining, exchanging and repairing components of the outdoor unit, by converting capacity of the outdoor unit sucking air from three sides and discharging it to a top surface into a front suction/discharge type, and separating a suction casing from a discharge casing.

In order to achieve the above-described objects of the invention, there is provided a built-in type outdoor unit for an air conditioner, including: a louver frame being fixedly installed on a rectangular space inner wall formed on an outer wall of a building, being divided into a suction area and a discharge area, including a plurality of louver blades in each area, and sucking and discharging air through gaps between the louver blades; and an outdoor unit casing being fixedly installed on the inside bottom of the building to contact the louver frame, and having its one surface facing the suction area and the discharge area of the louver frame opened and the other surfaces closed, wherein a compressor for compressing a refrigerant gas supplied from an indoor unit through pipe lines, an air-cooled condenser for condensing the refrigerant gas from the compressor, and a cooling fan for supplying external air to the air-cooled condenser through the suction area, and discharging heat exchanged air through the discharge area are installed in the outdoor unit casing.

Here, the louver frame includes an external frame composing a frame, and an internal frame being fastened to the external frame and including the louver blades, the internal frame further includes a dividing unit for dividing the louver blades of the suction area from the louver blades of the discharge area, and the dividing unit has its surface slanted to the discharge area.

Preferably, the outdoor unit casing is divided into a suction unit and a discharge unit corresponding to the suction area and the discharge area of the louver frame, the compressor and the air-cooled condenser are installed in the suction unit, and the cooling fan is installed in the discharge unit.

Preferably, the outdoor unit casing includes an outdoor unit suction casing which has its one surface facing the suction area of the louver frame opened and which the compressor and the air-cooled condenser are installed in, and an outdoor unit discharge casing which is coupled to or separated from the outdoor unit suction casing, which has its one surface facing the discharge area of the louver frame opened, and which the cooling fan is installed in, wherein opened surfaces are respectively formed in the outdoor unit suction casing and the outdoor unit discharge casing to connect them to discharge the sucked external air.

Preferably, a plurality of leg members for supporting load of the outdoor unit on the bottom of the building are externally protruded from the bottom surface of the outdoor unit casing, a leg reinforcing member for connecting and reinforcing the leg members in a horizontal direction is formed on the bottom surface of the outdoor unit casing, and the leg members further include screws for controlling height or transport wheels.

Preferably, a grill member for preventing invasion of animals is installed in front of one surface facing the suction area and the discharge area of the louver frame.

Preferably, a width of the outdoor unit casing is smaller than that of the inside space of the louver frame fixedly installed at the inside of the outer wall of the building, the outdoor unit further includes a fastening member for fastening the outdoor unit casing to the louver frame, and the fastening member includes 'L' shaped brackets.

Preferably, a plate shape vibration isolating member for absorbing vibration generated in the outdoor unit is further inserted between the louver frame and the outdoor unit casing.

Preferably, a sealing member for preventing air from being leaked from the suction unit and/or the discharge unit is further inserted between the louver frame and the outdoor unit casing.

Preferably, one of the other surfaces of the outdoor unit includes openings where pipes of a service valve are installed, a diameter of the openings is greater than that of the pipes to obtain gaps near the pipes, and the outdoor unit further includes a sealing member for opening/closing the gaps.

BEST MODE FOR CARRYING OUT THE INVENTION

A built-in type outdoor unit for an air conditioner in accordance with the present invention will now be described in detail with reference to the accompanying drawings.

Figure 1:
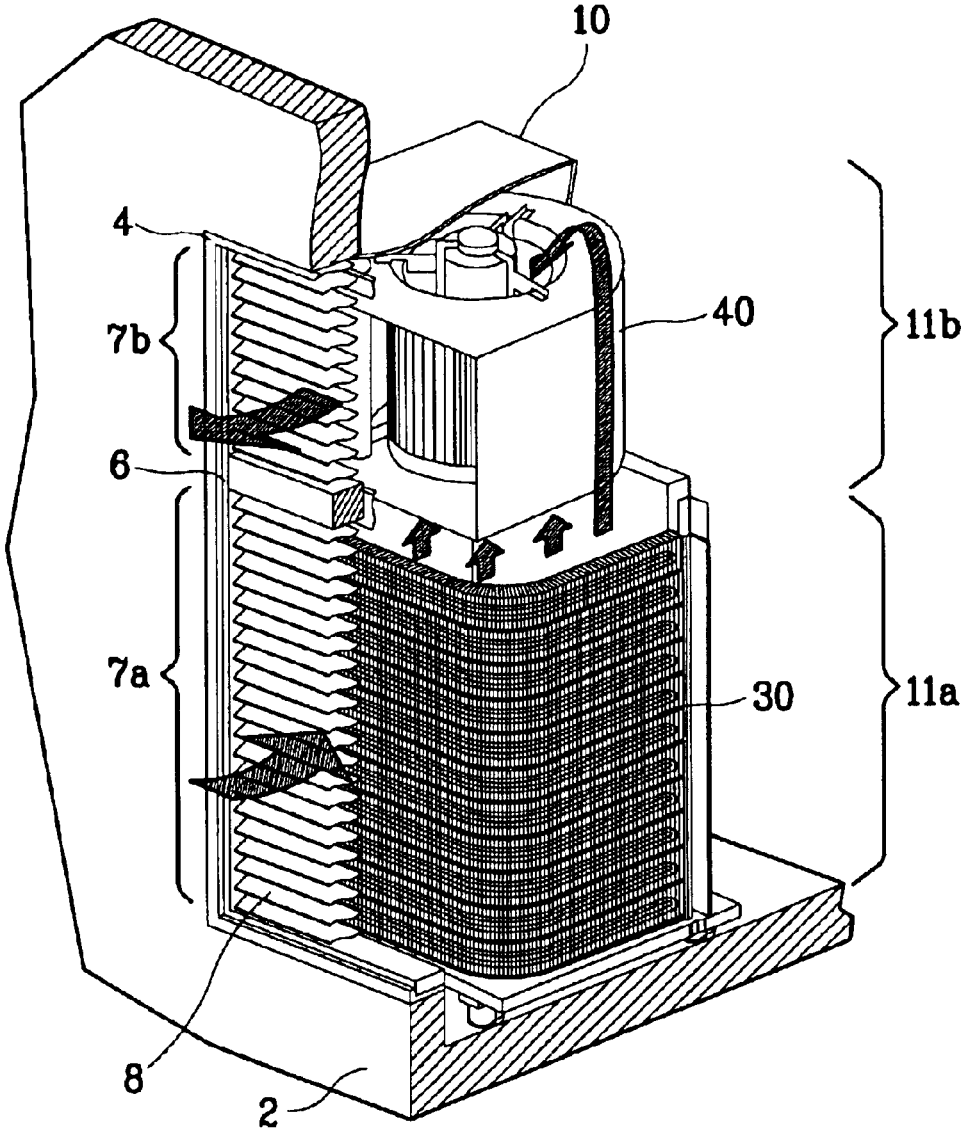
FIG. 1 is a partially-cut perspective-sectional view illustrating a built-in type outdoor unit for an air conditioner in accordance with a first embodiment of the present invention.
Figure 2:
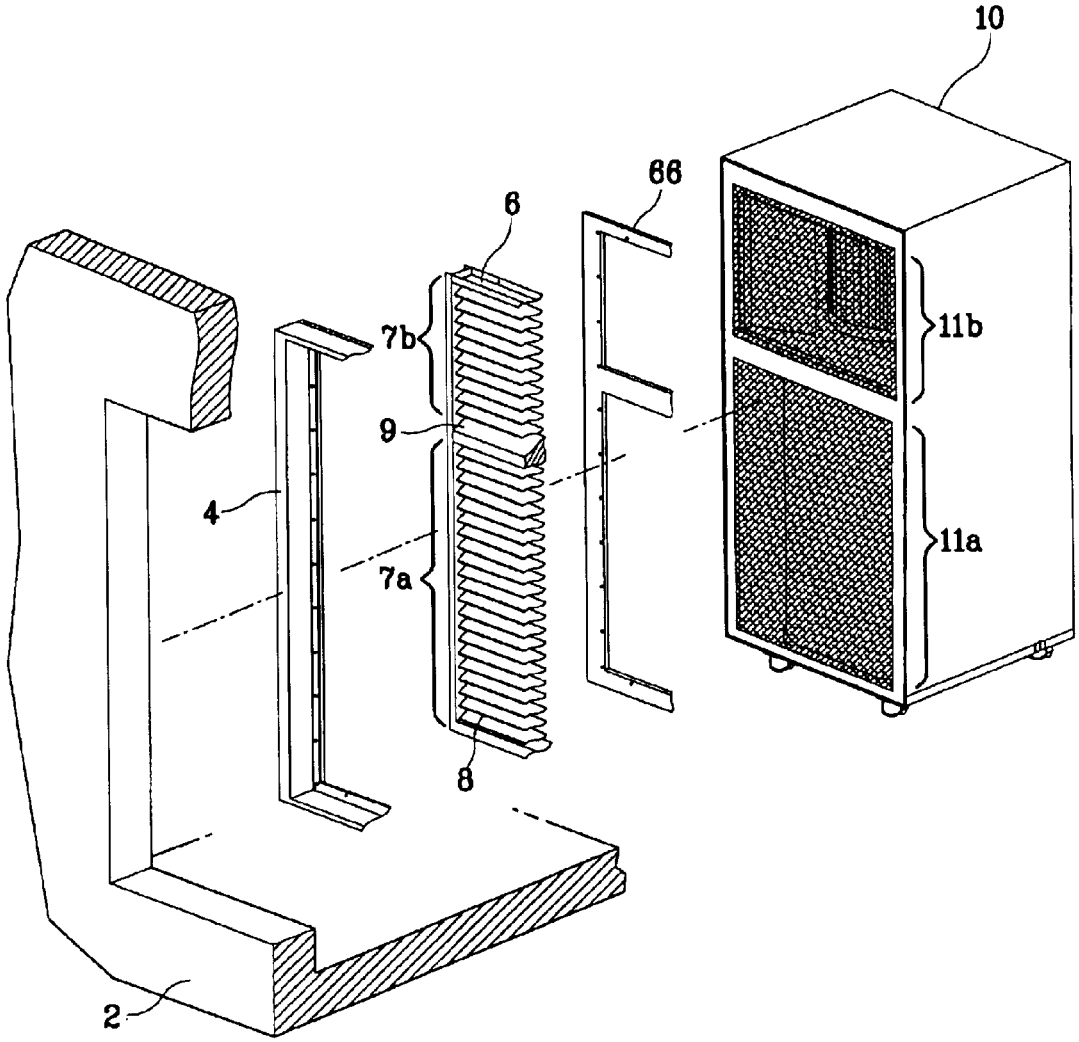
FIG. 2 is an exemplary view illustrating installation and assembly of the outdoor unit of FIG. 1.
Figure 3:
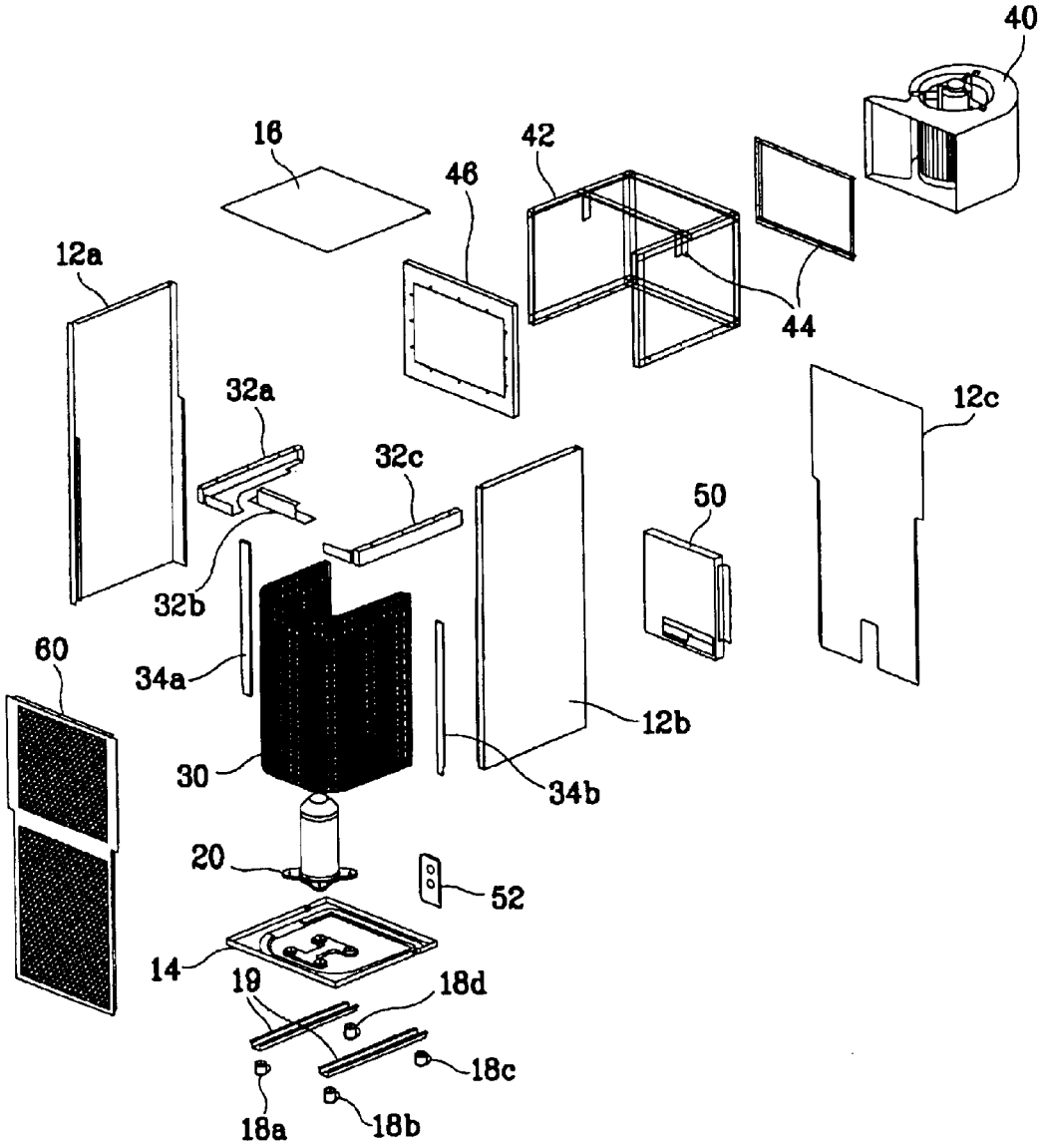
FIG. 3 is a perspective view illustrating disassembly of the outdoor unit of FIG. 1.

FIGS. 1 to 3 are structure views illustrating a built-in type outdoor unit for an air conditioner in accordance with a preferred embodiment of the present invention.

As illustrated in FIGS. 1 and 2, an external frame 4 is fixedly installed on a rectangular space inner wall formed on an outer wall 2 of a residential and/or commercial building, and an internal frame 6 is fixedly installed at the inside of the external frame 4. The internal and external frames 4 and 6 can be incorporated. An inside area of the internal frame 6 is divided into a suction area 7*a* and a discharge area 7*b*. A plurality of louver blades 8 are installed in each area, so that air can be sucked or discharged through gaps between the louver blades 8. Hereinafter, the external frame 4, the internal frame 6 and the louver blades 8 are referred to as a louver frame.

On the other hand, an outdoor unit 10 (partially shown) fixedly installed at the inside of the outer wall 2 of the building to contact the external frame 4 and/or internal frame 6 includes an outdoor unit casing. The outdoor unit casing opens its one side facing the suction area 7*a* and the discharge area 7*b* of the internal frame 6. The opened side is divided into a suction unit 11*a* and a discharge unit 11*b* to correspond to the suction area 7*a* and the discharge area 7*b* of the internal frame 6.

In addition, the louver frame coupled to or separated from the outdoor unit 10 includes a dividing unit 9 for dividing the louver blades of the suction area 7*a* from the louver blades 8 of the discharge area 7*b*. The dividing unit 9 divides the suction area 7*a* of the louver frame from the discharge area 7*b* at a predetermined interval, to prevent interferences between external air sucked to the suction area 7*a* and heat exchanged air discharged from the discharge area 7*b*. Accordingly, the front suction/discharge type outdoor unit 10 rapidly sucks external air and discharges heat exchanged air. The dividing unit 9 also prevents air discharged from the louver blades 8 at the lower end of the discharge area 7*b* from being re-sucked to the louver blades 8 at the upper end of the suction area 7*a*, namely isolates air of the suction area 7*a* from air of the discharge area 7*b*, thereby minimizing contacts of air sucked to the suction area 7*a* and heat exchanged air discharged from the discharge area 7*b*. The dividing unit 9 has its surface slanted to the discharge area 7*b*. When rain or snow flows down by the louver blades 8 of the discharge area 7*b*, the slanted surface of the dividing unit 9 externally discharges it.

An air suction/discharge direction can be controlled by adjusting an open angle of the louver blades 8. In addition, an air suction direction and an air discharge direction can be distinguished by controlling the louver blades 8 of the suction area 7*a* and the discharge area 7*b* to have different open angles. A manual open device (not shown) operated by force of the user, and an automatic open device (not shown) for automatically operating the louver blades 8 according to the operation of an outdoor unit 10, namely a control command of the outdoor unit 10 performing a series of operations for cooling/heating can be used as a control means for opening the louver blades 8. The structure and constitution of the manual open device and the automatic open device for the louver blades are easily understood by ordinary people skilled in the art to which the present invention pertains. It is also possible to determine the air suction/discharge direction in consideration of an external environment, and to open and maintain the louver blades 8 in a predetermined direction.

On the other hand, the outdoor unit 10 fixedly installed at the inside of the outer wall 2 of the building to contact the external frame 4 and/or internal frame 6 includes an outdoor unit casing composed of components of FIG. 3. In addition, outdoor unit components of FIG. 3 are installed in the outdoor unit casing.

In the outdoor unit casing, one side facing the suction area 7*a* and the discharge area 7*b* of the internal frame 6 is opened. The opened side is divided into a suction unit 11*a* and a discharge unit 11*b* to correspond to the suction area 7*a* and the discharge area 7*b* of the internal frame 6. In addition, three side covers 12*a*, 12*b* and 12*c*, a bottom cover 14 and a top cover 16 are closed to form a rectangular parallel piped. A plurality of leg members 18*a*, 18*b*, 18*c* and 18*d* are externally protruded from the bottom cover 14. The leg members 18*a*, 18*b*, 18*c* and 18*d* are installed on the bottom of a building, for example a veranda of an apartment building, for supporting heavy load of the outdoor unit 10. Preferably four leg members 18*a*, 18*b*, 18*c* and 18*d* are formed in consideration of the shape of the bottom cover 14. A leg reinforcing member 19 for connecting and reinforcing the leg members 18*a*, 18*b*, 18*c* and 18*d* is formed below the bottom cover 14 in the horizontal direction. The leg members 18*a*, 18*b*, 18*c* and 18*d* further include screws (not shown) for controlling height. Accordingly, when the bottom of the building, for example the veranda of the apartment building is not flat, they can stably position the outdoor unit 10. When the two legs 18*a* and 18*b* positioned in the forward direction (toward building outer wall) among the leg members 18*a*, 18*b*, 18*c* and 18*d* further include wheels (not shown), it is much easier to transport the heavy load outdoor unit 10.

In the suction unit 11*a* of the outdoor unit 10, a compressor 20 is installed on a compressor fastening unit 22, and a 'U' shaped air-cooled condenser 30 is fixedly supported on the side covers 12*a* and 12*b* and the bottom cover 14 by using condenser covers 32*a*, 32*b* and 32*c* and condenser brackets 34*a* and 34*b*. In the air-cooled condenser 30, a plurality of condenser pipe lines are formed in a zigzag shape between a plurality of condenser fins. The structure and shape of the air-cooled condenser 30 have been publicly known, and thus are not shown in detail. A refrigerant gas compressed by the compressor 20 is transmitted through the pipe lines of the condenser 30, removed its condensation heat by externally-supplied air, and condensed. In this case, the condenser covers 32*a*, 32*b* and 32*c* and the condenser brackets 34*a* and 34*b* form a wind path so as to prevent external air from being supplied to the discharge unit 11*b* not via the condenser 30. As a result, external air sucked through the gaps between the louver blades 8 of the suction area 7*a* passes through the 'U' shaped condenser 30 along the wind path of the condenser covers 32*a*, 32*b* and 32*c* and the condenser brackets 34*a* and 34*b*, and exchanges heat with the refrigerant gas flowing through the condenser pipe lines.

In the discharge unit 11*b* of the outdoor unit 10, a cooling fan 40 for supplying external air to the air-cooled condenser 30 through the suction area 7*a* and discharging heat exchanged air through the discharge area 7*b* is fixedly installed on the side covers 12*a*, 12*b* and 12*c* and the top cover 16 by a cooling fan supporting member 42 and a cooling fan bracket 44. A sirocco fan is illustrated as one example of the cooling fan 40. Reference numeral 46 denotes a fan front installed in front of the cooling fan 40.

A control box 50 for controlling the operation of the outdoor unit 10 is installed at the inside of the side cover 12*c* composing the rear surface among the side covers, and refrigerant pipe lines which the refrigerant gas evaporated in the indoor unit is sucked through, and a valve assembly 52, a path of the refrigerant pipe lines which the refrigerants condensed in the outdoor unit 10 are discharged through are installed below the control box 50.

A mesh shaped front grill 60 is additionally installed on the front surface of the outdoor unit 10, namely one opened side facing the suction area 7*a* and the discharge area 7*b* of the internal frame 6 to prevent invasion of animals (for example, rats).

Figure 4:
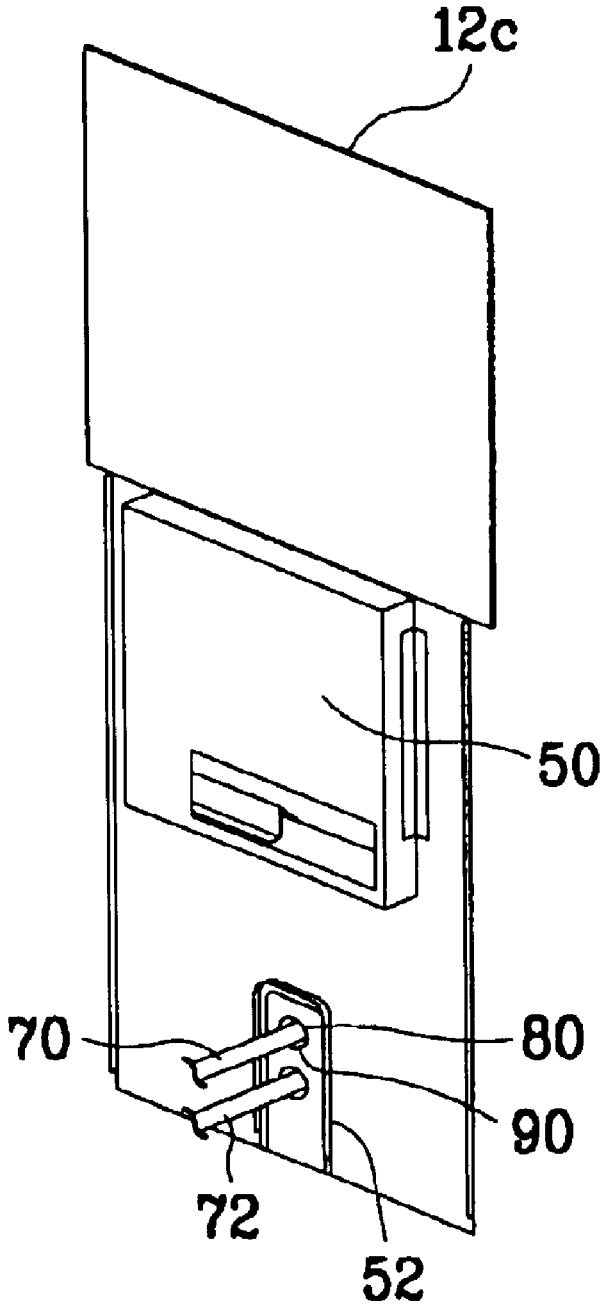
FIG. 4 is an exemplary view illustrating installation and assembly of a valve assembly of the outdoor unit of FIG. 1.

FIG. 4 is an exemplary view illustrating installation and assembly of the valve assembly of the outdoor unit of FIG. 1. As shown in FIG. 4, the control box 50 and the valve assembly 52 having openings 80 which pipes 70 and 72 of a service valve pass through are installed on the side cover 12*c*. The pipes 70 and 72 of the service valve are paths of the refrigerant pipe lines which the refrigerant gas evaporated in the indoor unit is sucked through and the refrigerant pipe lines which the refrigerants condensed in the outdoor unit are discharged through. A diameter of the openings 80 is greater than that of the pipes 70 and 72, and gaps 90 are formed between the openings 80 and the pipes 70 and 72, so that external air can be sucked into the outdoor unit thorough the gaps 90. In addition, a sealing member (not shown) for preventing external air from being sucked through the gaps 90 can be used.

In the case that the indoor unit performs a heating operation, air sucked through the gaps 90 near the pipes 70 and 72 is hot air. Therefore, the gaps 90 are sealed up by using the sealing member, and the control box 50 and/or the air-cooled condenser 30 are/is cooled by using cool air passing through the air-cooled condenser 30.

When the indoor unit performs a cooling operation, air sucked through the gaps 90 near the pipes 70 and 72 is cooler than air passing through the air-cooled condenser 30. Accordingly, the sealing member is removed from the gaps 90, and the control box 50 and/or the air-cooled condenser 30 are/is cooled by using air sucked through the gaps 90.

Figure 5:
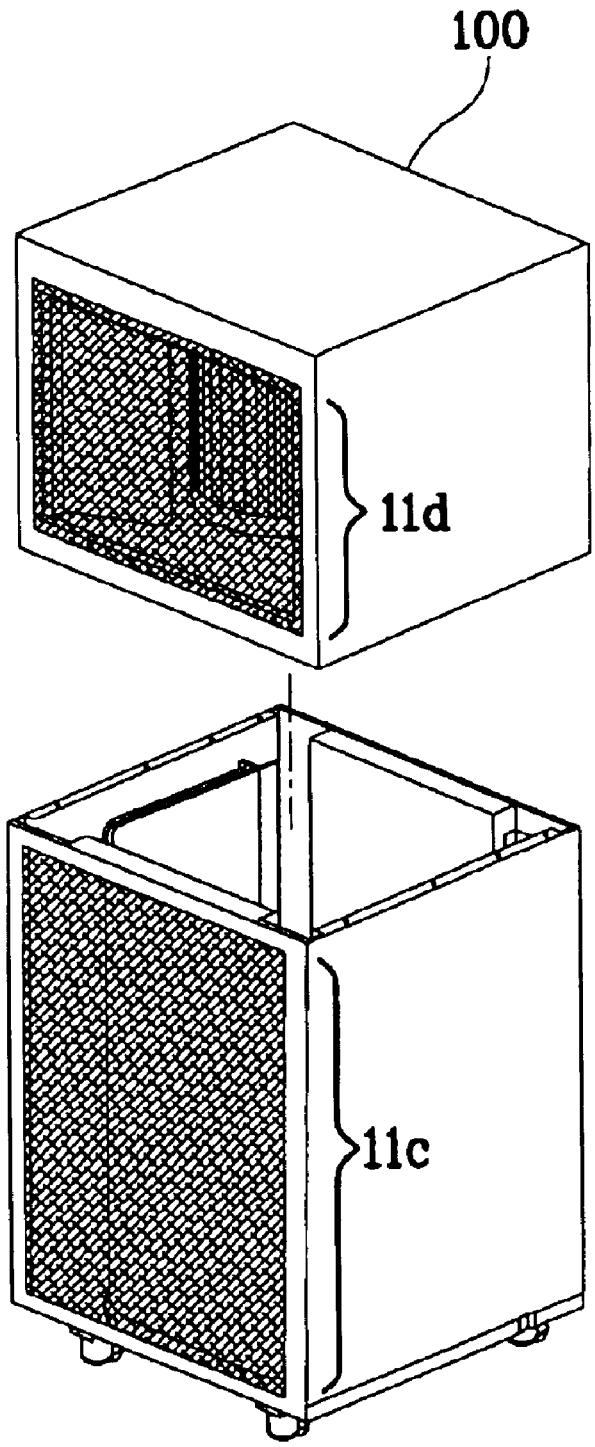
FIG. 5 is a perspective view illustrating an outdoor unit in accordance with a second embodiment of the present invention.

FIG. 5 is a perspective view illustrating an outdoor unit casing in accordance with a second embodiment of the present invention. Referring to FIG. 5, the outdoor unit 100 includes a separable outdoor unit suction casing 11*c* and a separable outdoor unit discharge casing 11*d*. Here, the outdoor unit suction casing 11*c* and the outdoor unit discharge casing 11*d* have their one surface opened to correspond to the suction area 7*a* and the discharge area 7*b* of the louver frame, and their another surface connected so that heat exchanged air can move through. That is, the outdoor unit suction casing 11*c* corresponds to the suction unit 11*a* of the outdoor unit 10, and the outdoor unit discharge casing 11*d* corresponds to the discharge unit 11*b* of the outdoor unit 10. The outdoor unit suction casing 11*c* and the outdoor unit discharge casing 11*d* can be coupled to or separated from each other by using a special fastening device (bolts and nuts, guide holes and hooks, etc.) (not shown).

The outdoor unit 100 which can be coupled/separated reduces its whole weight and size to be easily transported and moved. The outdoor unit 100 can also be easily installed by firstly installing the outdoor unit suction casing 11*c*, and then installing the outdoor unit discharge casing 11*d*. For management and repair, the outdoor unit 100 is partially separated and disassembled so that its inside components can be examined. That is, the outdoor unit 100 has a simplified structure in time and cost.

Figure 6:
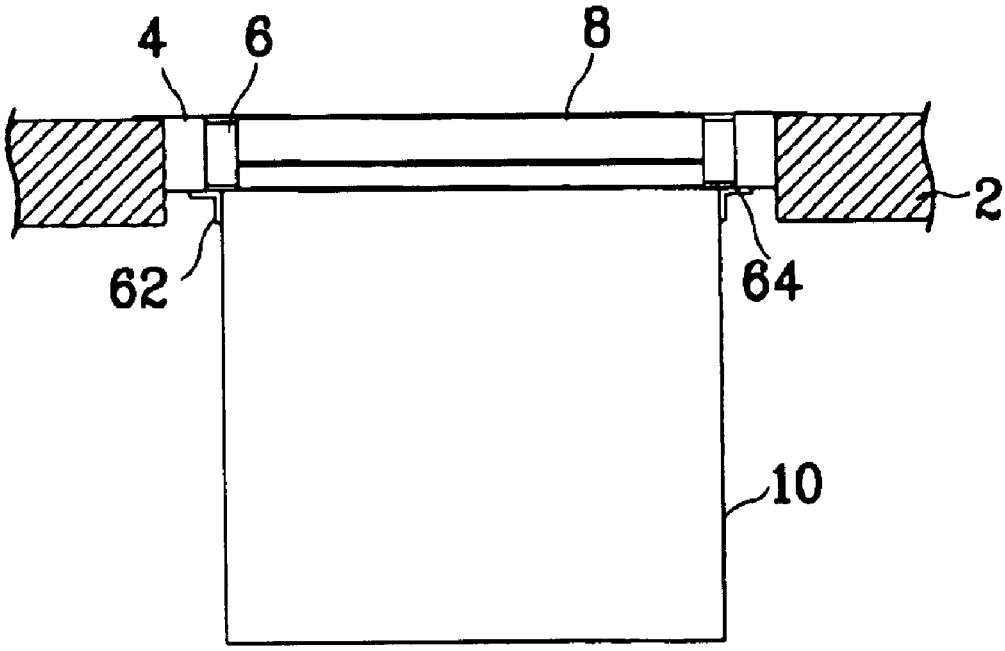
FIG. 6 is a plan view illustrating mounted constitution of the outdoor unit of FIG. 1.

FIG. 6 is a plan view illustrating mounted constitution of the louver frame and the outdoor unit of FIG. 1. As illustrated in FIG. 6, a width of the outdoor unit 10 is smaller than that of an internal space of the external frame 4 fixedly installed at the inside of the outer wall, and thus the outdoor unit 10 is fixed to the external frame 4 and the side covers 12*a* and 12*b* by using a special fastening member, for example 'L' shaped brackets 62. In this case, the outdoor unit 10 is not fixed to the concrete outer wall 2, and thus is easily fixedly installed. In addition, a gap exists between the concrete outer wall 2 and the outdoor unit 10 as large as the external frame 4, and thus the outdoor unit 10 is easily fixedly installed.

Moreover, a plate shape sealing member 64 is inserted between the internal frame 6 and the outdoor unit casing, so that external air sucked through the suction area 7*a* can pass through the suction unit 11*a* without being leaked to other spaces (for example, discharge unit 11*b*), and that air discharged from the discharge unit 11*b* can be externally discharged through the discharge area 7*b* without being leaked to other spaces (for example, suction unit 11*a*). A plate shape vibration isolating member 66 is inserted into the front surface of the outdoor unit casing so that the outdoor unit 10 can absorb vibration of the cooling fan (not shown).

A fastening member, a plate shape sealing member and a plate shape vibration isolating member can also be applied to the separable outdoor unit 100 like the outdoor unit 10.

Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. A built-in type compressor/condenser unit for an air conditioner, comprising:

a louver frame being fixedly installed on a rectangular inner wall space formed on an outer wall of a building, being divided into a suction area and a discharge area, including a plurality of louver blades in each area, and sucking and discharging air through gaps between the louver blades; and a compressor/condenser unit casing being fixedly installed on the inside bottom of the building to contact the louver frame, and having its one surface facing the suction area and the discharge area of the louver frame opened and the other surfaces closed, wherein a compressor for compressing a refrigerant gas supplied from an indoor unit through pipe lines, and air-cooled condenser for condensing the refrigerant gas from the compressor, and a cooling fan for supplying external air to the air-cooled condenser through the suction area, and discharging heat exchanged air through the discharge area are installed in the compressor/condenser unit casing, and wherein a leg reinforcing member for connecting and reinforcing a plurality of leg members formed protruded from a bottom surface of the compressor/condenser unit casing in a horizontal direction is formed on the bottom surface of the compressor/condenser unit casing.

2. A built-in type compressor/condenser unit for an air conditioner, comprising:

a louver frame being fixedly installed on a rectangular inner wall space formed on an outer wall of a building, being divided into a suction area and a discharge area, including a plurality of louver blades in each area, and sucking and discharging air through gaps between the louver blades; and a compressor/condenser unit casing being fixedly installed on the inside bottom of the building to contact the louver frame, and having its one surface facing the suction area and the discharge area of the louver frame opened and the other surfaces closed, wherein a compressor for compressing a refrigerant gas supplied from an indoor unit through pipe lines, and air-cooled condenser for condensing the refrigerant gas from the compressor, and a cooling fan for supplying external air to the air-cooled condenser through the suction area, and discharging heat exchanged air through the discharge area are installed in the compressor/condenser unit casing, and wherein the compressor/condenser unit casing includes leg members comprising screws for controlling a height of the compressor/condenser unit casing.

3. A built-in type compressor/condenser unit for an air conditioner, comprising:

a louver frame being fixedly installed on a rectangular inner wall space formed on an outer wall of a building, being divided into a suction area and a discharge area, including a plurality of louver blades in each area, and sucking and discharging air through gaps between the louver blades; and a compressor/condenser unit casing being fixedly installed on the inside bottom of the building to contact the louver frame, and having its one surface facing the suction area and the discharge area of the louver frame opened and the other surfaces closed, wherein a compressor for compressing a refrigerant gas supplied from an indoor unit through pipe lines, and air-cooled condenser for condensing the refrigerant gas from the compressor, and a cooling fan for supplying external air to the air-cooled condenser through the suction area, and discharging heat exchanged air through the discharge area are installed in the compressor/condenser unit casing, and wherein a width of the compressor/condenser unit casing is smaller than that of the inside space of the louver frame fixedly installed at the inside of the outer wall of the building, and a fastening member comprising 'L' shaped brackets fastens the compressor/condenser unit casing to the louver frame.

4. A built-in type compressor/condenser unit for an air conditioner, comprising:

a louver frame being fixedly installed on a rectangular inner wall space formed on an outer wall of a building, being divided into a suction area and a discharge area, including a plurality of louver blades in each area, and sucking and discharging air through gaps between the louver blades; and a compressor/condenser unit casing being fixedly installed on the inside bottom portion of the building to contact the louver frame, and having its one surface facing the suction area and the discharge area of the louver frame opened and the other surfaces closed, wherein a compressor for compressing a refrigerant gas supplied from an indoor unit through pipe lines, and air-cooled condenser for condensing the refrigerant gas from the compressor, and a cooling fan for supplying external air to the air-cooled condenser through the suction area, and discharging heat exchanged air through the discharge area are installed in the compressor/condenser unit casing, wherein a width of the compressor/condenser unit casing is smaller than that of the inside space of the louver frame fixedly installed at the inside of the outer wall of the building, and a fastening member fastens the compressor/condenser unit casing to the louver frame, and wherein a plate shape vibration isolating member for absorbing vibration generated in the compressor/condenser unit is further inserted between the louver frame and the compressor/condenser unit casing.

5. A built-in type compressor/condenser unit for an air conditioner, comprising:

a louver frame being fixedly installed on a rectangular inner wall space formed on an outer wall of a building, being divided into a suction area and a discharge area, including a plurality of louver blades in each area, and sucking and discharging air through gaps between the louver blades; and a compressor/condenser unit casing being fixedly installed on the inside bottom of the building to contact the louver frame, and having its one surface facing the suction area and the discharge area of the louver frame opened and the other surfaces closed, wherein a compressor for compressing a refrigerant gas supplied from an indoor unit through pipe lines, and air-cooled condenser for condensing the refrigerant gas from the compressor, and a cooling fan for supplying external air to the air-cooled condenser through the suction area, and discharging heat exchanged air through the discharge area are installed in the compressor/condenser unit casing, and wherein one of the other surfaces of the compressor/condenser unit comprises openings where pipes of service valve are installed.

6. The compressor/condenser unit of claim 5, wherein a diameter of the openings is greater than that of the pipes to obtain gaps near the pipes.

7. The compressor/condenser unit of claim 6, further comprising a sealing member for opening/closing the gaps.

* * * * *